US008764071B2

(12) United States Patent
Lanigan et al.

(10) Patent No.: US 8,764,071 B2
(45) Date of Patent: Jul. 1, 2014

(54) DOOR MANAGEMENT SYSTEM FOR FIELD SERVICE AND DELIVERY PERSONNEL

(75) Inventors: William P. Lanigan, Orland Park, IL (US); John J. Wepfer, Orland Park, IL (US); Maciej Labowicz, Roselle, IL (US); Gary A. Naese, Bonfield, IL (US); Gerald F. Chalko, Jr., Highland, IN (US)

(73) Assignee: Mi-Jack Systems & Technology, LLC, Hazel Crest, IL (US)

( * ) Notice: Subject to any disclaimer, the term of this patent is extended or adjusted under 35 U.S.C. 154(b) by 0 days.

(21) Appl. No.: 13/453,639

(22) Filed: Apr. 23, 2012

(65) Prior Publication Data

US 2012/0204490 A1 Aug. 16, 2012

Related U.S. Application Data

(62) Division of application No. 11/601,857, filed on Nov. 17, 2006, now abandoned.

(51) Int. Cl.
*E05B 65/10* (2006.01)
*E05F 15/02* (2006.01)

(52) U.S. Cl.
USPC ..... 292/92; 292/93; 292/251.5; 292/341.16; 292/DIG. 25; 49/139; 49/340

(58) Field of Classification Search
USPC ..... 292/DIG. 65, DIG. 15, DIG. 25, 70–79, 292/251.5, 341.15, 341.16, 92–94, DIG. 56; 49/141, 340, 139
See application file for complete search history.

(56) References Cited

U.S. PATENT DOCUMENTS

| | | | | | |
|---|---|---|---|---|---|
| 736,714 | A | * | 8/1903 | Gendron | 16/401 |
| 1,089,963 | A | * | 3/1914 | Reinert | 49/276 |
| 2,066,277 | A | * | 12/1936 | Keil | 292/341.16 |
| 2,073,149 | A | * | 3/1937 | Geyer | 292/337 |
| 2,984,510 | A | * | 5/1961 | Hoffmann | 292/142 |
| 2,984,520 | A | * | 5/1961 | Wadell | 301/43 |
| 4,365,442 | A | * | 12/1982 | Speer | 49/346 |
| 4,452,015 | A | * | 6/1984 | Jacques et al. | 49/386 |
| 4,660,324 | A | * | 4/1987 | Nyenbrink | 49/340 |
| 4,763,937 | A | * | 8/1988 | Sittnick et al. | 292/251.5 |
| 4,867,496 | A | * | 9/1989 | Thomas | 292/341.16 |
| 4,979,261 | A | * | 12/1990 | Lasier et al. | 16/62 |
| 5,311,168 | A | * | 5/1994 | Pease et al. | 340/542 |
| 5,375,374 | A | * | 12/1994 | Rohraff, Sr. | 49/340 |
| 5,490,698 | A | * | 2/1996 | Dezso | 292/138 |
| 5,790,034 | A | * | 8/1998 | Khoury | 340/5.64 |
| 5,831,403 | A | * | 11/1998 | Kanki et al. | 318/286 |
| 5,865,483 | A | * | 2/1999 | Dubravin | 292/251.5 |
| 5,956,249 | A | * | 9/1999 | Beran et al. | 700/56 |
| 5,987,818 | A | * | 11/1999 | Dabideen | 49/280 |

(Continued)

*Primary Examiner* — Carlos Lugo
*Assistant Examiner* — Alyson M Merlino
(74) *Attorney, Agent, or Firm* — McCracken & Frank LLC

(57) ABSTRACT

A system for use with a emergency exit door, comprising: a door opener including a stationary actuator with a movable distal arm for pushing the door open; a door strike mountable to a door frame having an opening to receive a latch of the emergency exit door, the electric door strike including a gate having a locked condition and a release condition; a controller connected to the door opener and the door strike; a remote activator having a triggered condition, which provides a signal to the controller when the remote activator is triggered, to unlock the gate and then the door opener, to open the emergency exit door.

25 Claims, 19 Drawing Sheets

(56) References Cited

U.S. PATENT DOCUMENTS

| | | | | |
|---|---|---|---|---|
| 6,138,412 | A * | 10/2000 | Rieckmann et al. | 49/349 |
| 6,325,429 | B1 * | 12/2001 | Oxley | 292/341.16 |
| 6,454,324 | B1 * | 9/2002 | Lewis et al. | 292/341.16 |
| 6,553,717 | B2 * | 4/2003 | St. John et al. | 49/340 |
| 6,588,153 | B1 * | 7/2003 | Kowalczyk | 49/380 |
| 6,675,535 | B2 * | 1/2004 | Armstrong et al. | 49/340 |
| 6,745,581 | B2 * | 6/2004 | King et al. | 62/131 |
| 6,926,318 | B2 * | 8/2005 | Oxley | 292/341.16 |
| 2004/0098915 | A1 * | 5/2004 | Baldry | 49/339 |
| 2005/0091928 | A1 * | 5/2005 | Okulov et al. | 49/341 |
| 2008/0115543 | A1 * | 5/2008 | Lanigan et al. | 70/57.1 |

* cited by examiner

DOOR MANAGEMENT SYSTEM FOR FIELD SERVICE AND DELIVERY PERSONNEL

CROSS-REFERENCE TO RELATED PATENT APPLICATIONS

This patent application is a divisional of co-pending U.S. patent application Ser. No. 11/601,857, filed Nov. 17, 2006.

FIELD OF THE INVENTION

This invention relates to a system and apparatus for use in connection with field and/or delivery personnel, to enable such workers to work more efficiently.

BACKGROUND OF THE INVENTION

A need exists for field and delivery workers to work more efficiently. For example, field workers and delivery personnel are often required to do the following: 1. Drive to an establishment, such as a store, restaurant, or a fast food restaurant, and park a delivery vehicle near a delivery/emergency exit door. 2. Exit the vehicle and walk to the front door. 3. Unlock the front door with a mechanical key and enter the store. 4. Re-lock the front door from inside. 5. Proceed to the security alarm system and disarm it within an allotted time. 6. Turn on lights and walk to back of the store to the delivery entrance. 7. Open the delivery/emergency exit door and block it open with any available equipment (e.g. a fire extinguisher). 8. Load merchandise from the truck on a cart or hand dolly. 9. Deliver merchandise though the opened/blocked door. 10. Repeat steps 8 and 9 until the delivery is complete while the door is blocked open. 11. When the delivery is complete, unblock the delivery/emergency exit door and close it from the inside. 12. Turn the alarm system back on and turn the lights off. 13. Unlock the front door, exit the store, and relock it with the mechanical key. 14. Return to the delivery vehicle near the delivery/emergency exit door to proceed to next delivery stop.

A solution to this cumbersome process is provided by this invention. A more detailed explanation of the invention is provided in the following description and claims, and is illustrated in the accompanying drawings.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF THE INVENTION

Figure 1:
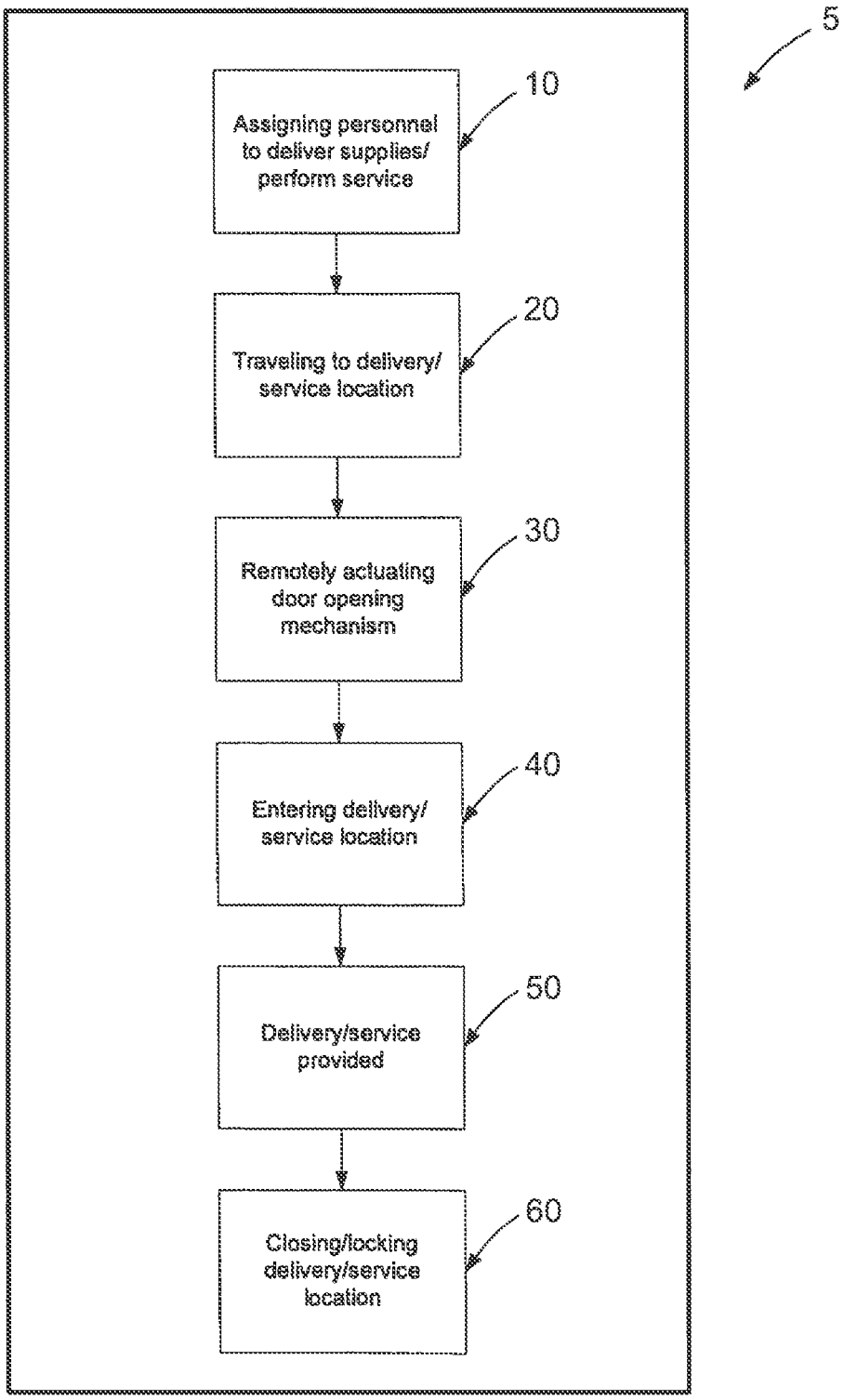
FIG. 1 is a flow diagram of the delivery system for field and delivery workers, in accordance with the instant invention.

Turning now to the drawings, and more particularly to FIG. 1 thereof, a block diagram of a delivery system 5 is shown. In its simplest form, it includes the steps of: assigning field personnel to enable them to provide a delivery or service at a designated location 10 (hereafter assigning step 10); traveling to the designated location to provide an on-site delivery or service 20 (hereafter traveling step 20); remotely actuating an opening mechanism to open an emergency exit door 30 (hereafter actuating step 30); entering the designated location through the emergency exit door opening 40 (hereafter entering step 40); providing a delivery or service at the designated location 50 (hereafter providing step 50); and closing and locking the emergency exit door after the delivery or service has been substantially completed 60 (hereafter closing step 60). The delivery system disclosed here, is a more efficient and cost effective method then those presently known.

In more detail, the actuating step 30 includes an applying step, to provide a sufficient threshold force in a substantially outwardly direction and substantially perpendicular direction to the emergency exit door, to open the door. This step provides a simple and durable method and means of opening an emergency exit door.

Figure 6:
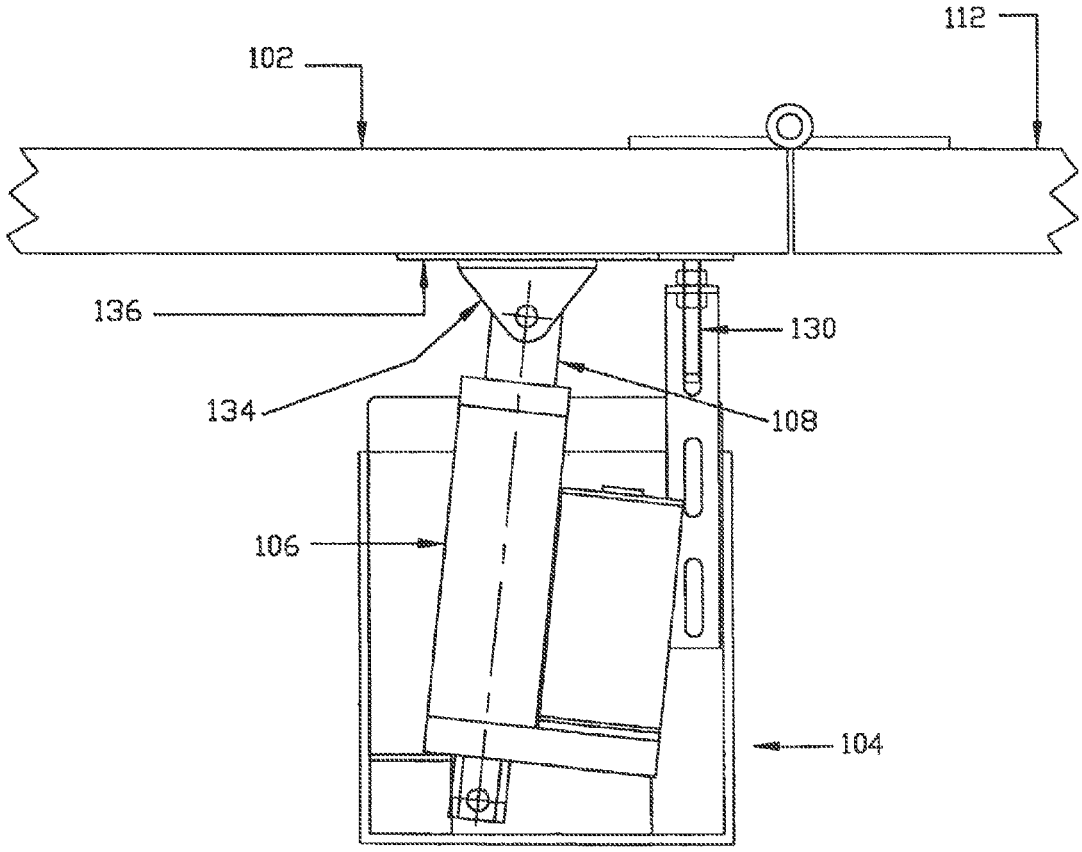
FIG. 6 includes an A-A view of an embodiment as depicted in FIG. 4, with a preferred actuator when the door is in a closed position, in accordance with the instant invention.
Figure 7:
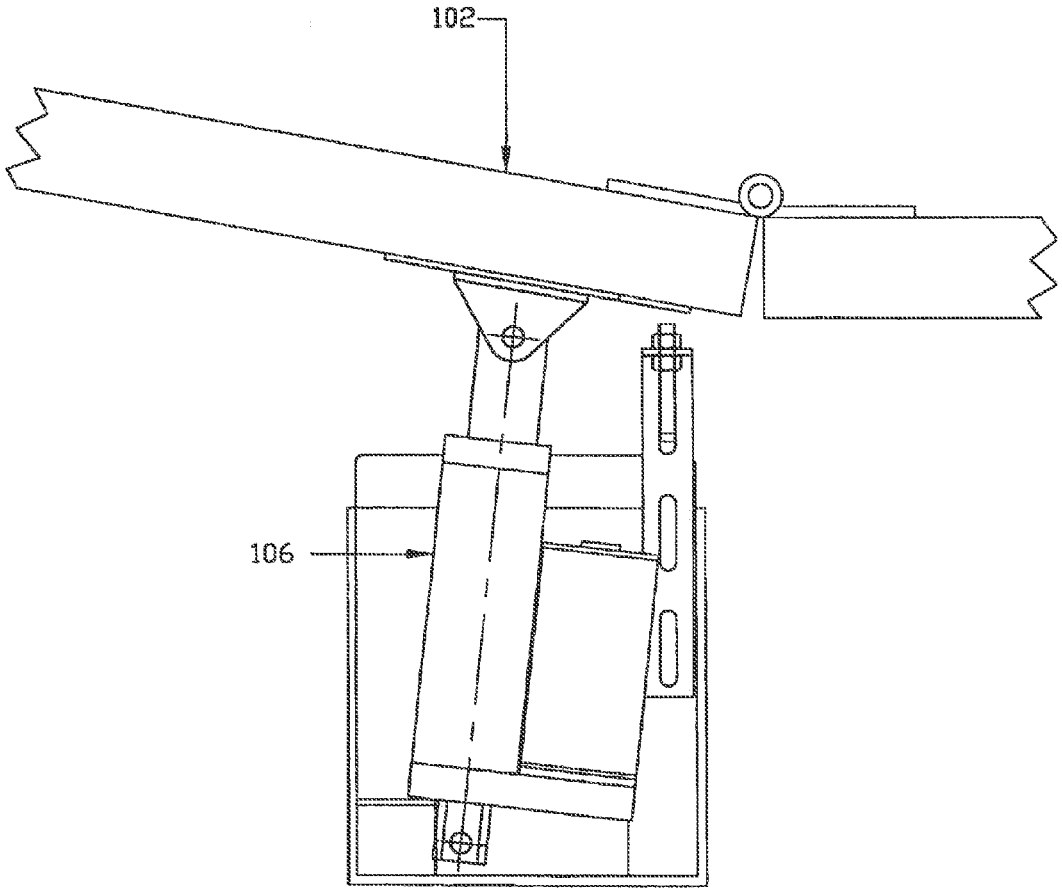
FIG. 7 includes an A-A view of an embodiment as depicted in FIG. 6, with a preferred actuator when the door is in a partially opened position, in accordance with the instant invention.

In a preferred embodiment, the applying step includes application of a sufficient threshold force step, such as providing a force of at least about 20 lbs., depending on the position of such force, for a smooth and sufficient opening force, as shown in FIGS. 6 and 7. In a preferred embodiment, the applying step includes providing a force of at least 25 lbs. to about 300 lbs. or more, when applied in proximity to a hinge, for an efficient and sufficient opening force.

Figure 13:
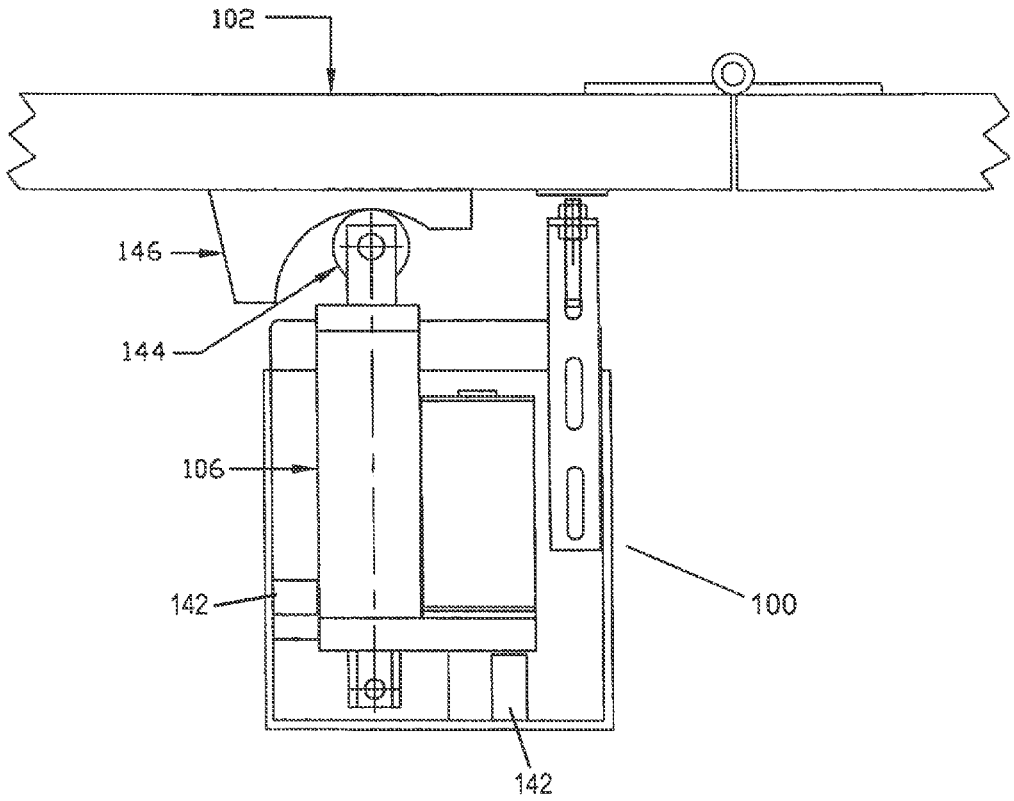
FIG. 13 includes an A-A view of an embodiment as depicted in FIG. 4, with a preferred actuator having a force centering roller and force centering adapter or interface, when the door is in a closed position, in accordance with the instant invention.
Figure 14:
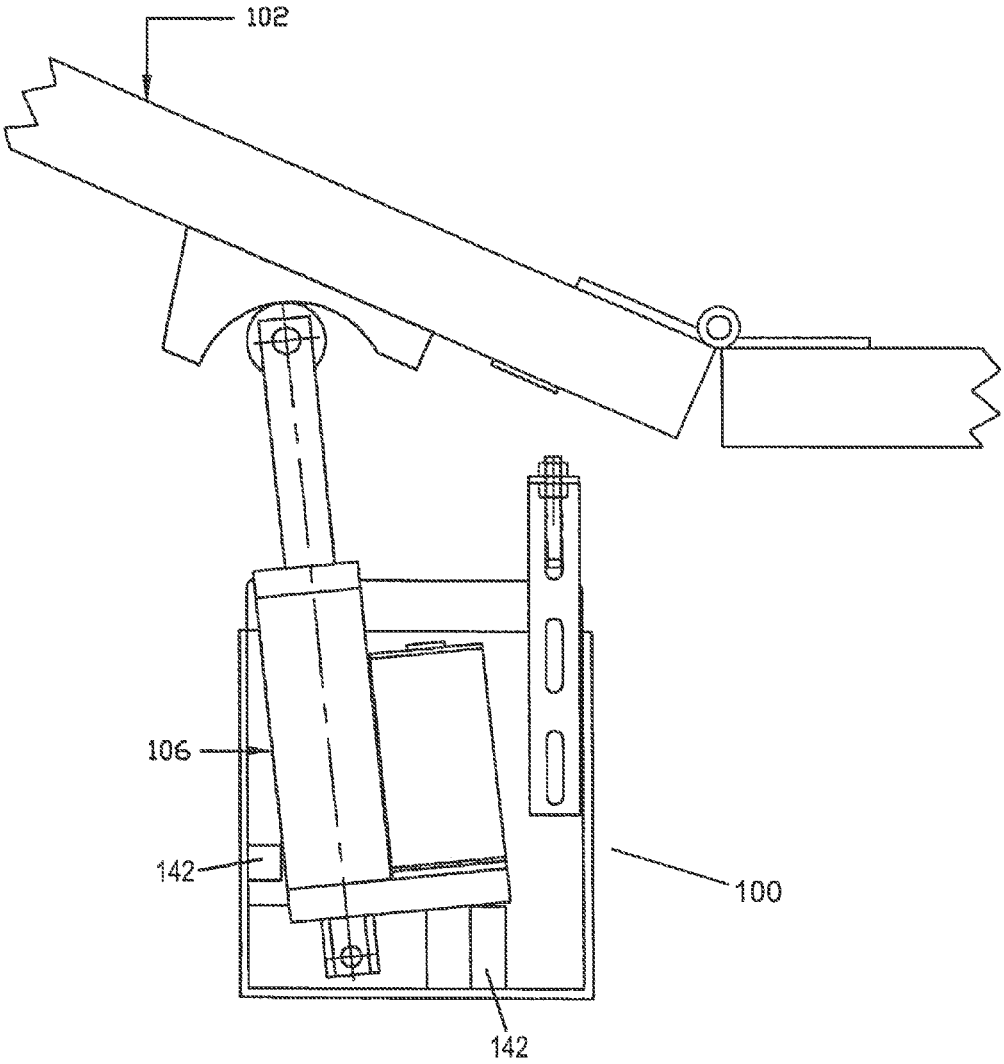
FIG. 14 includes an A-A view of an embodiment as depicted in FIG. 13, with a preferred actuator having a force centering roller and force centering adapter or interface, when the door is in a partially opened position and the actuator is still shown in contact with the door through the adapter, in accordance with the instant invention.
Figure 15:
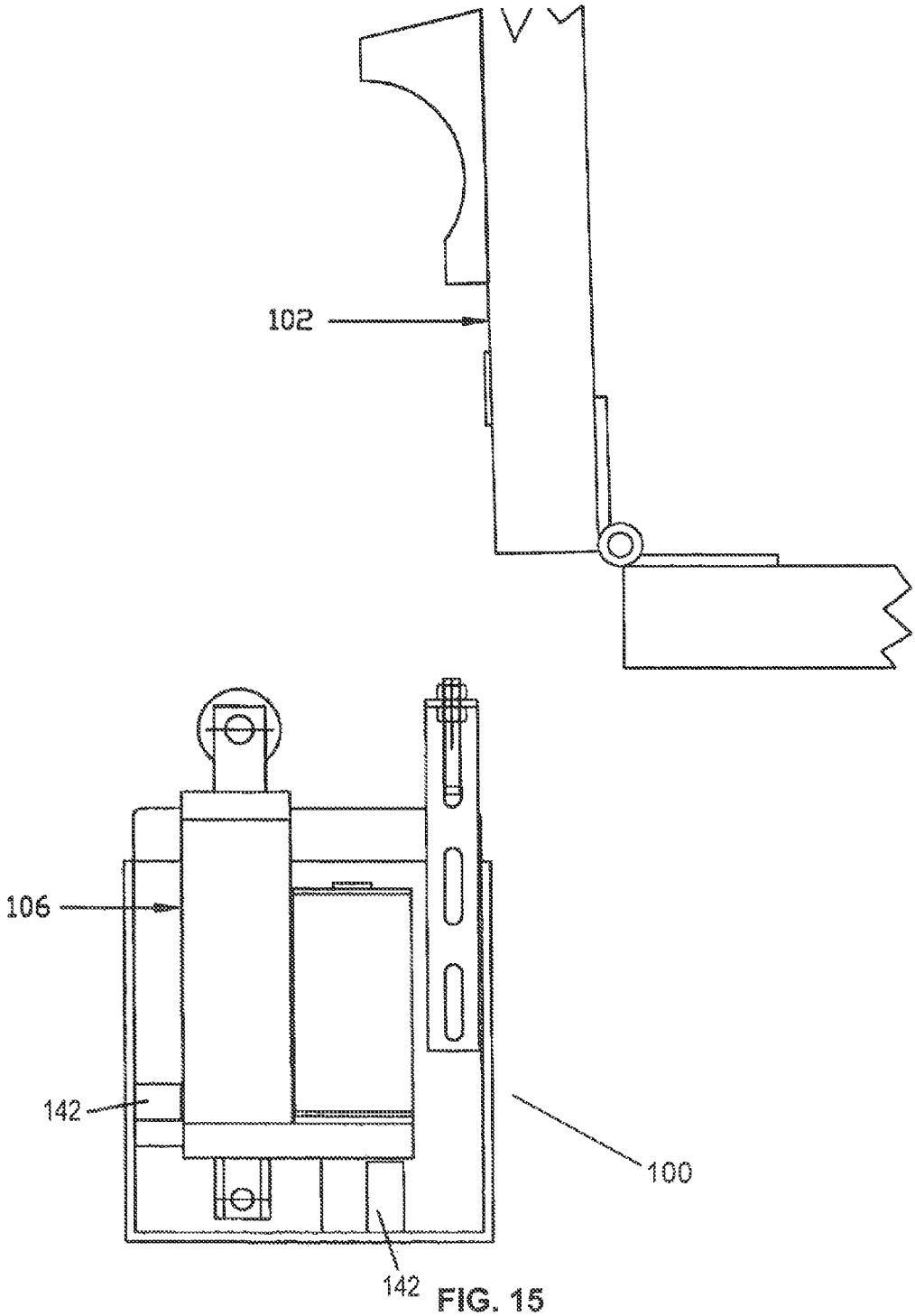
FIG. 15 includes an A-A view of an embodiment as depicted in FIG. 13, with a preferred actuator having a force centering roller and force centering adapter or interface, when the door is in a fully opened position, and the actuator is substantially not shown in contact with the door through the adapter, in accordance with the instant invention.
Figure 16:
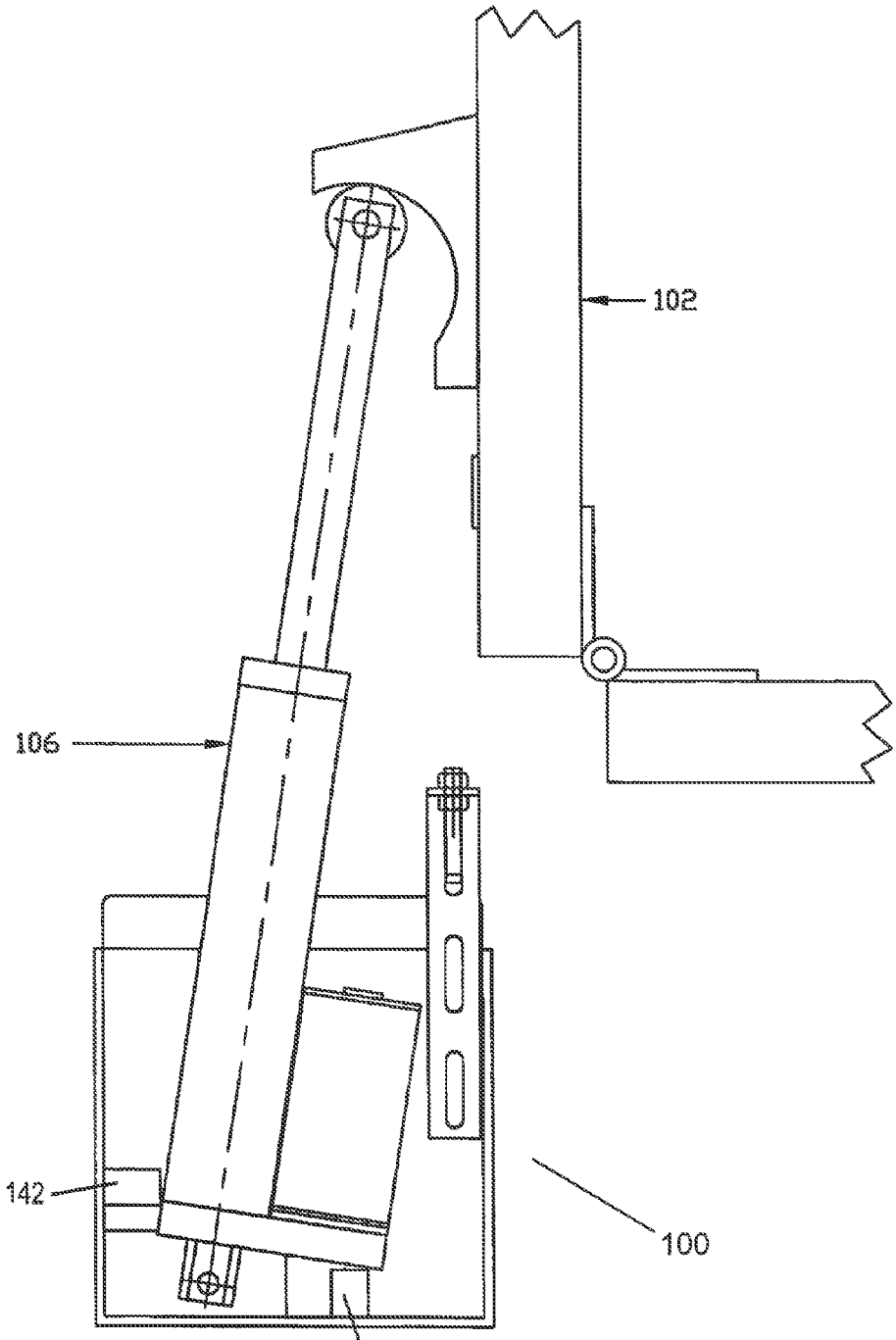
FIG. 16 includes an A-A view of an embodiment as depicted in FIG. 13, with a preferred actuator having a force centering roller and force centering adapter or interface, when the door is in a fully opened position, and the actuator in this embodiment is shown extended and in contact with the door through the adapter, in accordance with the instant invention.

In more detail, the remotely actuating step 30 can include the steps of: applying a sufficient threshold force in a substantially outwardly direction and substantially perpendicular direction to the emergency exit door 102; providing the threshold force in the substantially perpendicular direction ranging from zero degrees to about 30 degrees from the perpendicular direction of the emergency exit door 102; and minimizing a side load to an actuator 106, as shown in FIGS. 13, 14 and 16. This combination of steps provides a smooth and efficient opening and can contribute to providing a longer useful life of the delivery system 5 and associated apparatus utilized herein.

In a preferred embodiment, providing the threshold force in the substantially perpendicular direction ranging from about zero degrees to about 20 degrees from the perpendicular direction, advantageously helps to minimize a disadvantageous side load to the actuator 106, relative to the actuating step 30. In such an embodiment, the side load is minimal or near zero at half stroke, which is beneficial to maximizing the useful life of the system and actuating step 30. Side loads or radial loads can reduce the life of actuator 106.

Figure 2:
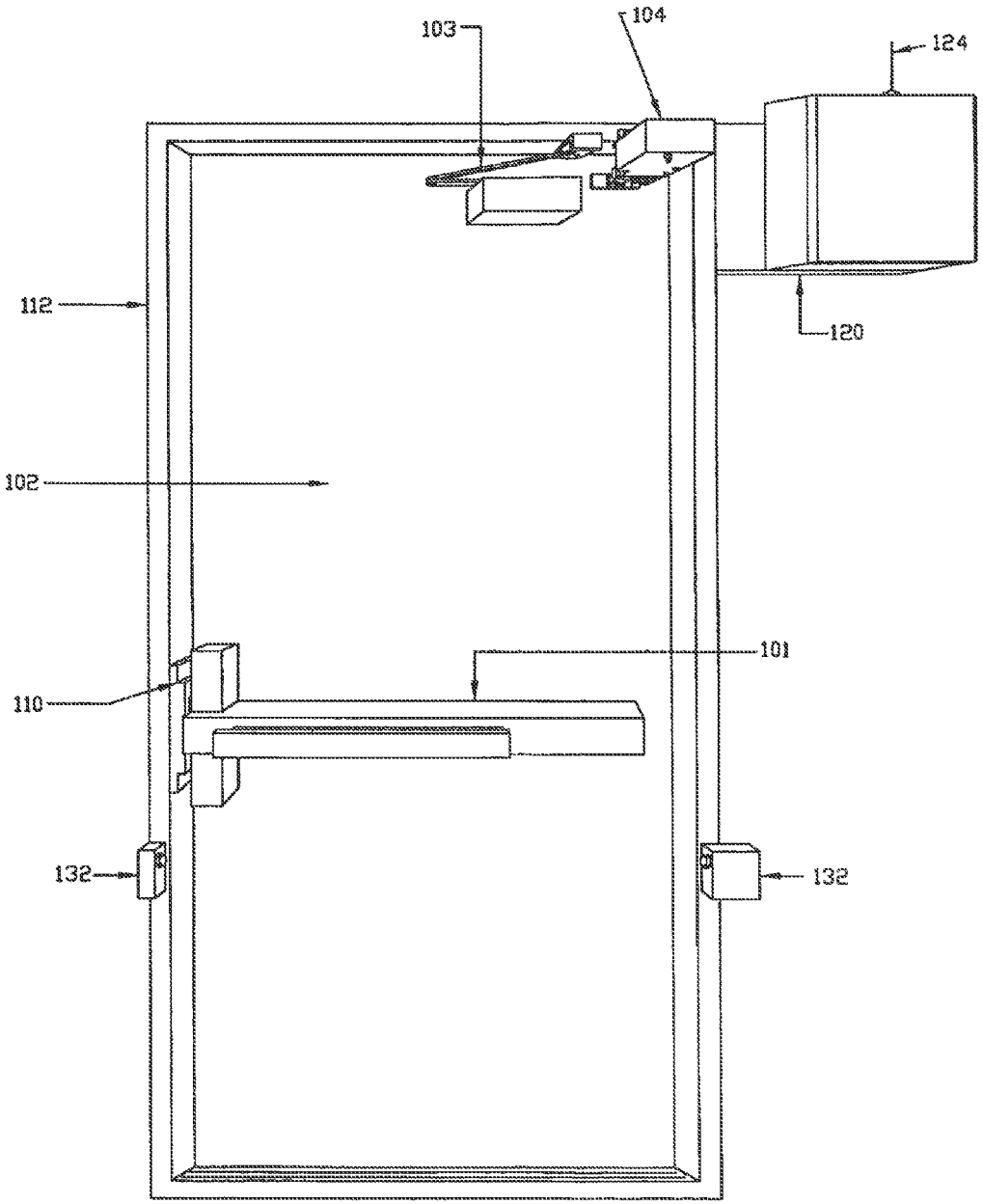
FIG. 2 is an interior view of an emergency exit door with associated structure, such as a control box, door opener, electric door strike and motion sensors, in accordance with the instant invention.

Also in a preferred embodiment, the actuating step 30 includes locating the outwardly pushing force at a location and position which is substantially minimally invasive to the emergency exit door opening, to allow free and unobstructed access through such door, as illustrated in FIG. 2. The locating step can include positioning the pushing force in proximity to an upper corner of the emergency exit door 102 near a side of the door where hinges are normally located for free access through the door 102.

Figure 8:
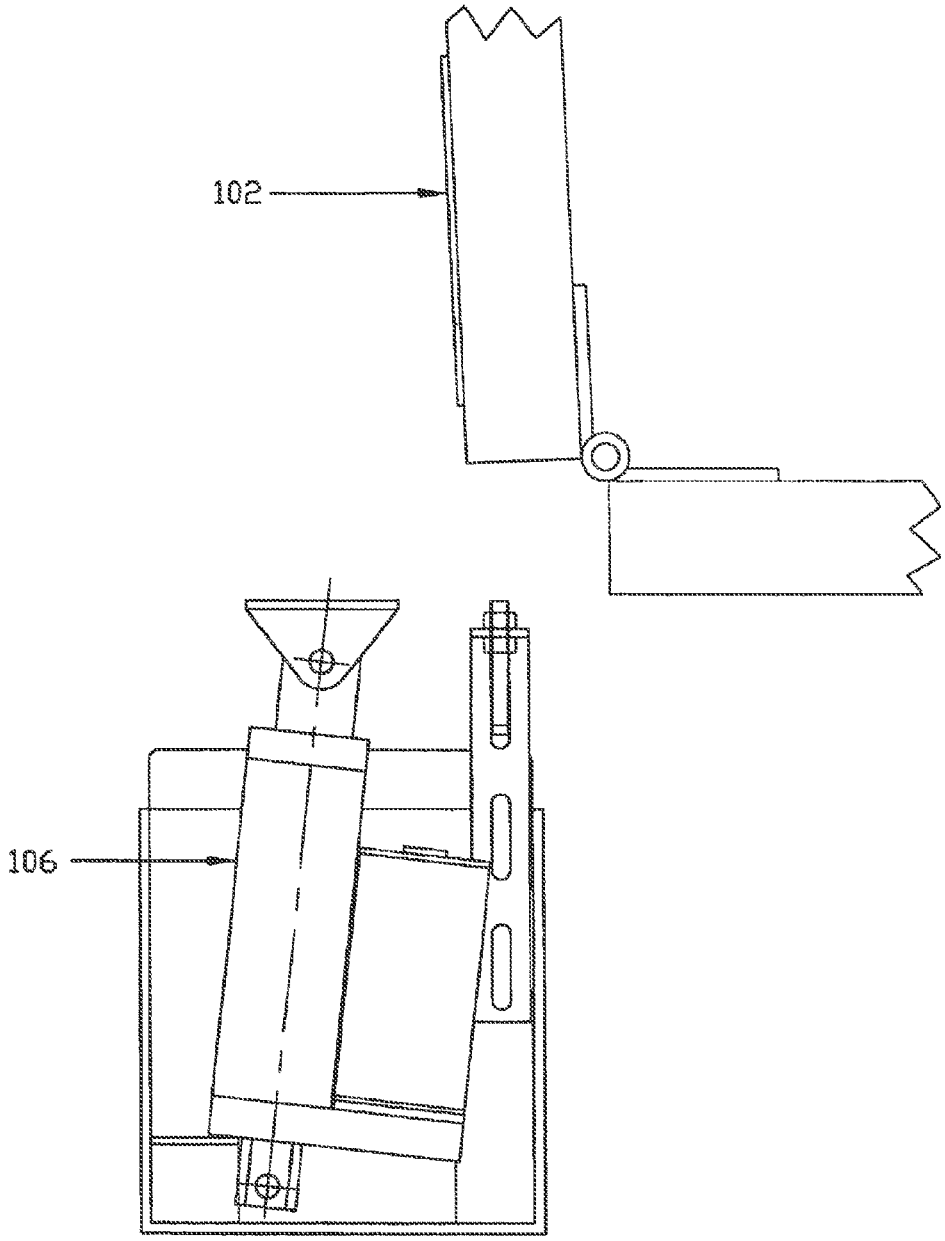
FIG. 8 includes an A-A view of an embodiment as depicted in FIG. 6, with a preferred actuator when the door is in a fully opened position, in accordance with the instant invention.

In one embodiment, the actuating step includes: applying a sufficient threshold force in an outwardly direction and in a substantially perpendicular direction to the emergency exit door 102 (FIG. 6); energizing an electric strike 110 to unlock the door 102 (FIG. 5), and providing an opening mechanism 104 which is substantially free of being mechanically connected to the emergency exit door 102 (FIG. 8). It is important not to hinder or obstruct the emergency exit and not alter the main function of door 102, which is for emergency exiting. Further, the providing step which is substantially free of being mechanically connected to the door 102, allows a field worker to push and swing the door 102 open, to keep such door 102 out of the way during field work or emergency exit, for example (FIG. 8).

In more detail, the providing step 30 can include: providing a plunging mechanism to contact the emergency exit door to push in a substantially outwardly direction; and providing a receiving interface for contacting the plunging mechanism, operatively connected to an inside of the emergency exit door 102 (FIG. 6). Preferably, a minimal friction pad 136 or interface, such as a Teflon-like pad is provided for protection to the door 102 and reduces friction for pushing and sliding, for smooth and a substantially non-binding opening movement.

In a preferred embodiment, the interface includes a substantially concave cup 146 complementarily constructed to receive a portion of a roller 144 of the actuator 106 (FIGS. 13-16). This construction can substantially eliminate a side load to the actuator 106, for enhanced useful life to the actuator 106, while maintaining detachability as well, as detailed herein.

Figure 3:
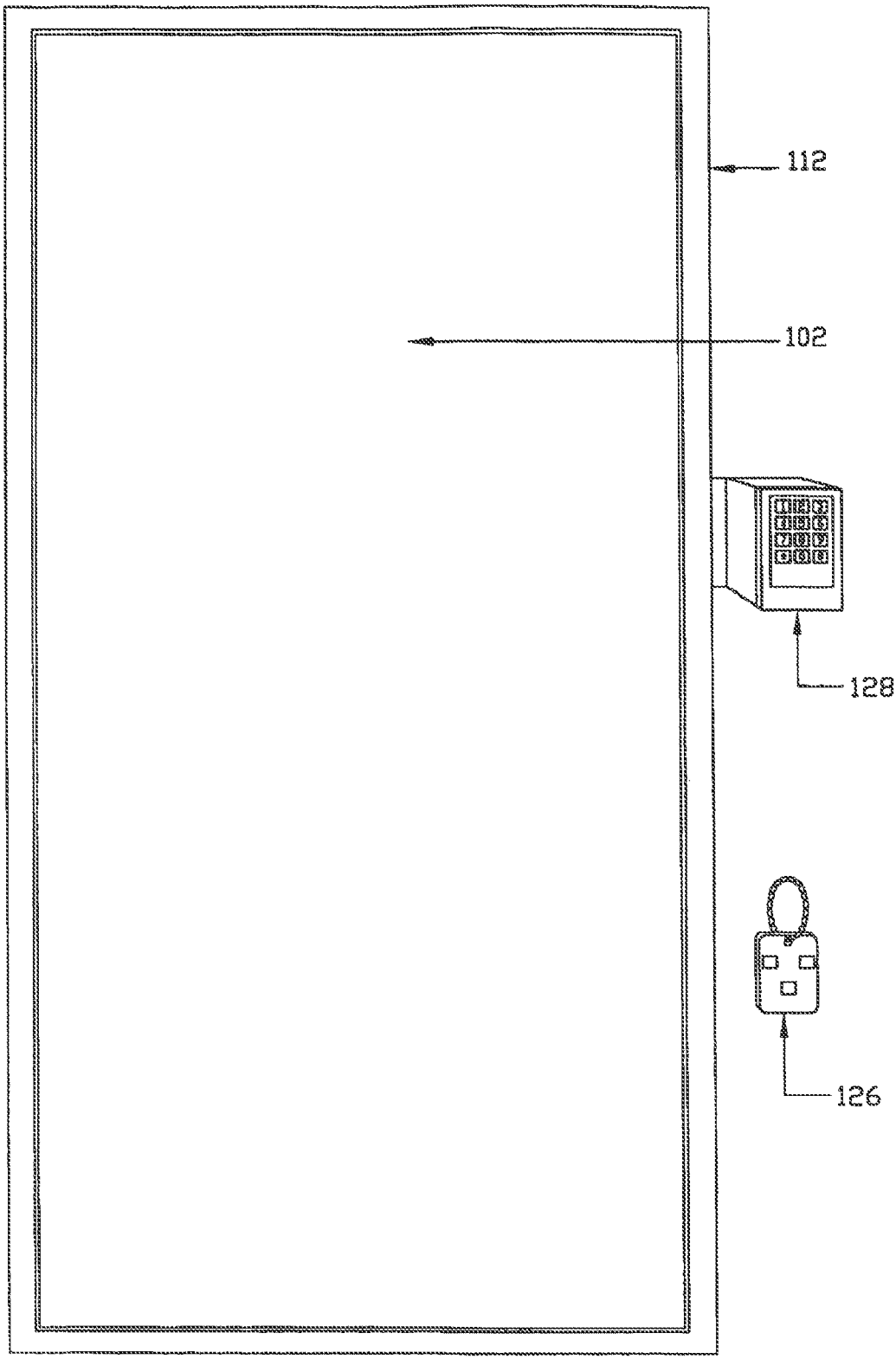
FIG. 3 is an exterior view of an emergency exit door with associated structure, such as a keypad and a typical RF (radio frequency) key fob in accordance with the instant invention.

In one embodiment, the actuating step 30 includes a wired device, such as a keypad 128 or a wireless device, such as an RF key fob 126, etc. for actuation, for example (FIG. 3). As will be appreciated by those skilled in the art, various types of RF communication devices can be used as means for wireless communication. In a preferred embodiment, the actuating step 30 includes providing an RF key fob 126 with at least one of an open signal, an alarm disable signal, a re-activate alarm signal and a panic signal.

In a preferred embodiment, the actuating step 30 further includes activating the electric door strike mechanism to release a pivoting structure of the door strike mechanism, to allow the door 102 to open (FIG. 5); and pushing the door 102 in an outwardly direction thereafter (FIG. 6). This is necessary, as it should be noted, that the door 102 herein is typically an emergency exit door 102, which typically cannot be opened from the outside, without first activating the door strike mechanism before opening such door.

Figure 5:
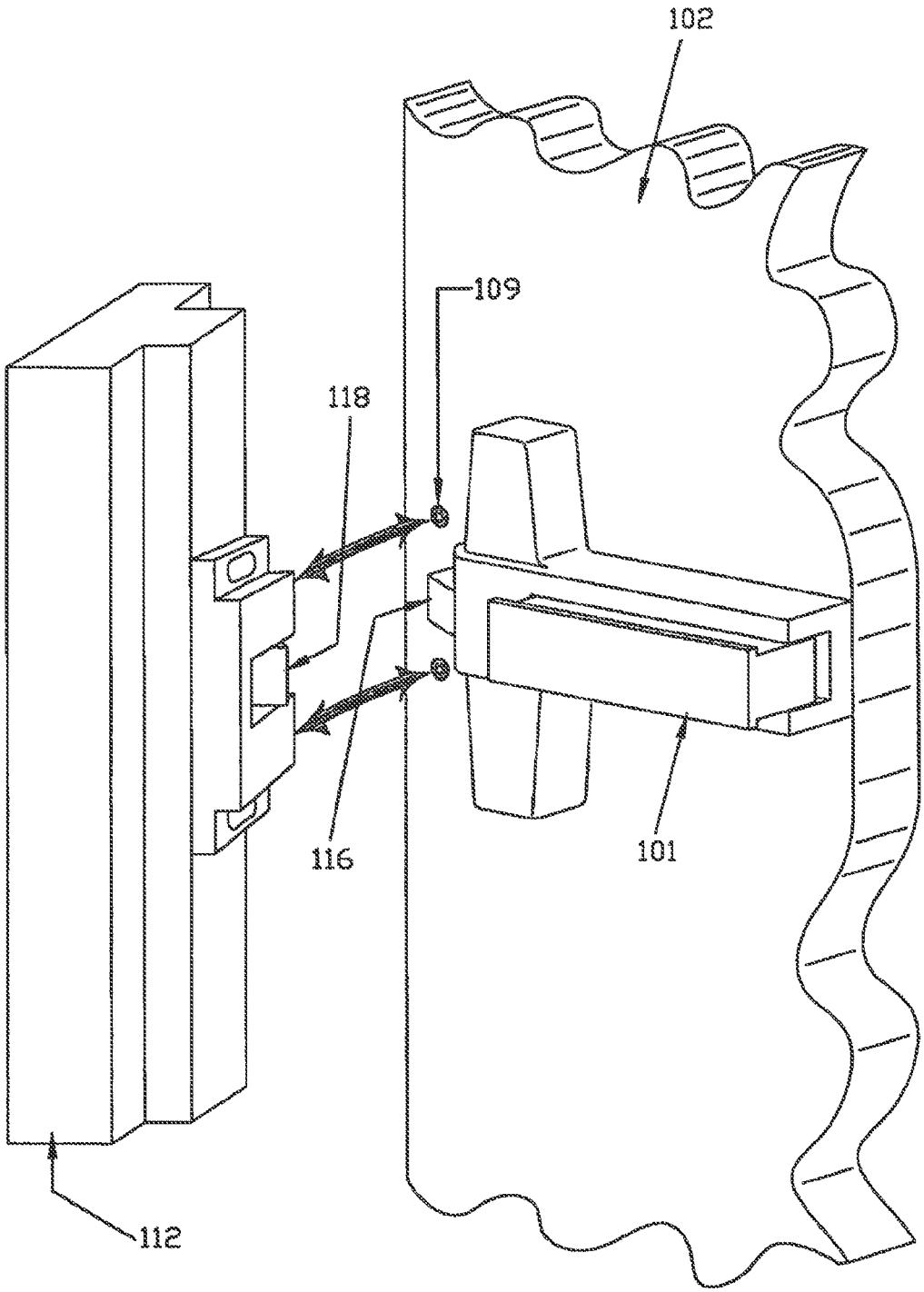
FIG. 5 shows an exploded view of a typical electric door strike and placement of door magnets, in accordance with the instant invention.
Figure 5A:
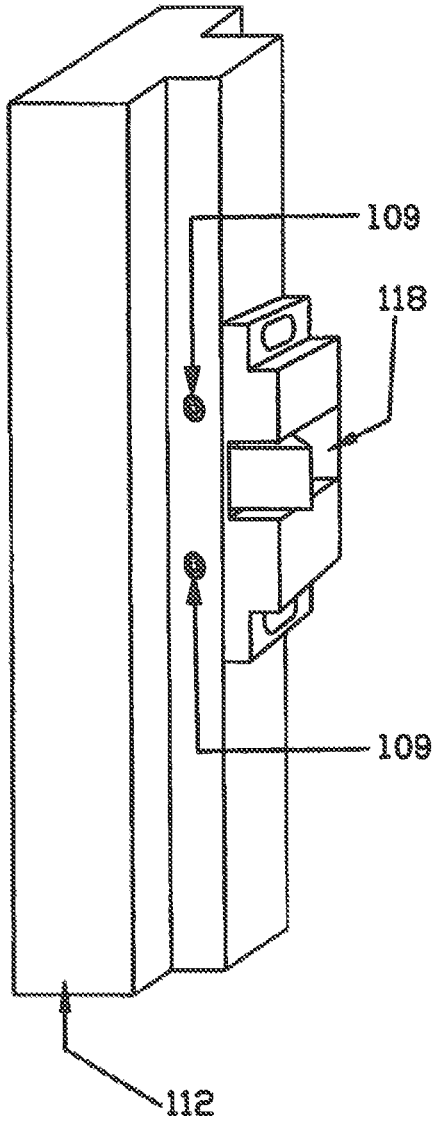
FIG. 5A is a perspective showing placement of door magnets on the door jamb, in accordance with the instant invention.

Also in a preferred delivery system 5, a providing step may include a substantially inwardly directed force, to maintain the door in a fully closed position, until activated. This force utilizes magnets 109 strategically positioned, connected to and partially embedded in proximity to a door jamb, which help to maintain such an inwardly directed force on a metal door 102, for example (FIG. 5). In addition, this force does not adversely affect the emergency exit door 102 and maintains the door 102 in a properly closed position. More specifically, this structure advantageously helps to eliminate outward force on the door, which could cause the door strike mechanism to be inoperable. When there is a certain threshold outward force, such as an excessive in-building air pressure, or boxes stacked against the door, the solenoid of the electric door strike mechanism may not be strong enough to release the mechanism, causing it to be inoperative. This problem is resolved by the use of the providing step as detailed herein (FIG. 5).

Figure 11:
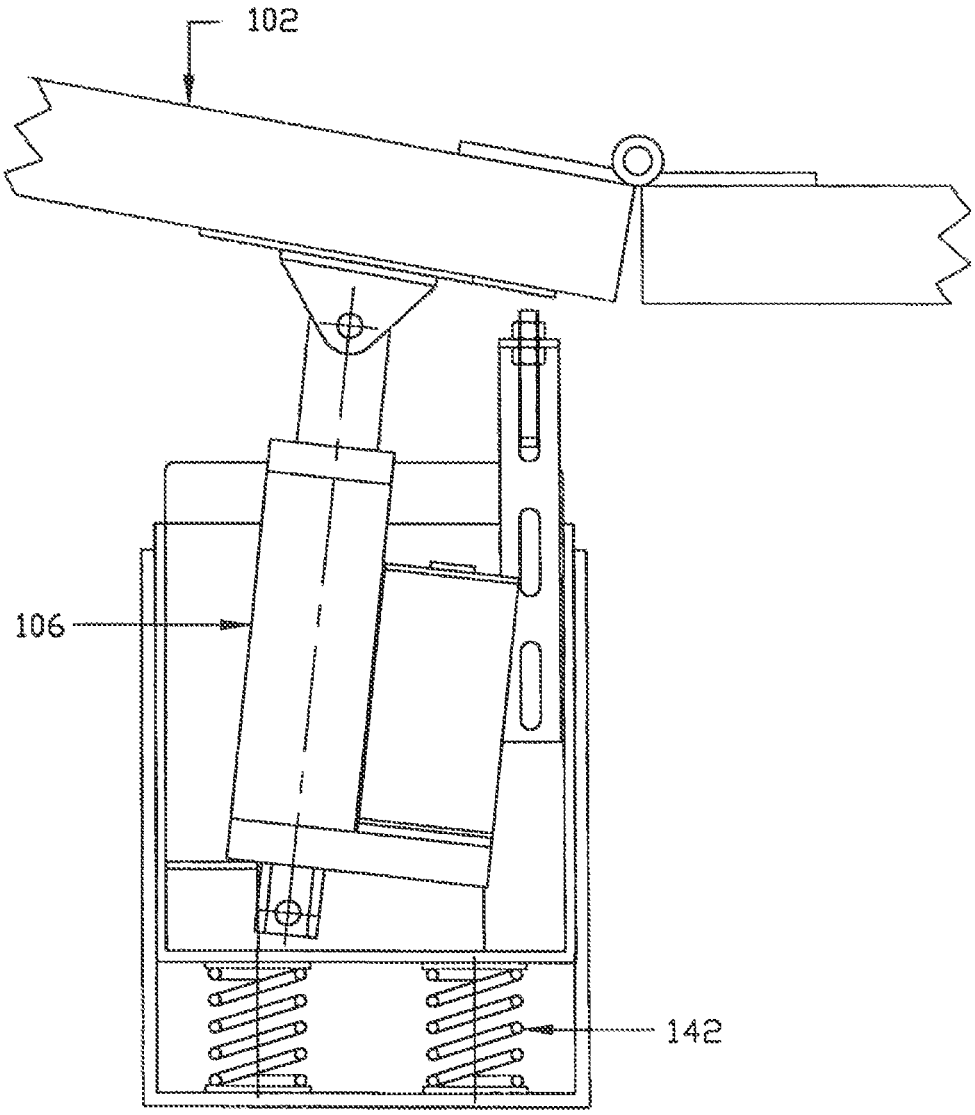
FIG. 11 includes an A-A view of an embodiment as depicted in FIG. 10, with a preferred actuator when the door is in a partially opened position, the door and door opener are shown in contact, and shown with shock absorbing structure, in accordance with the instant invention.
Figure 12:
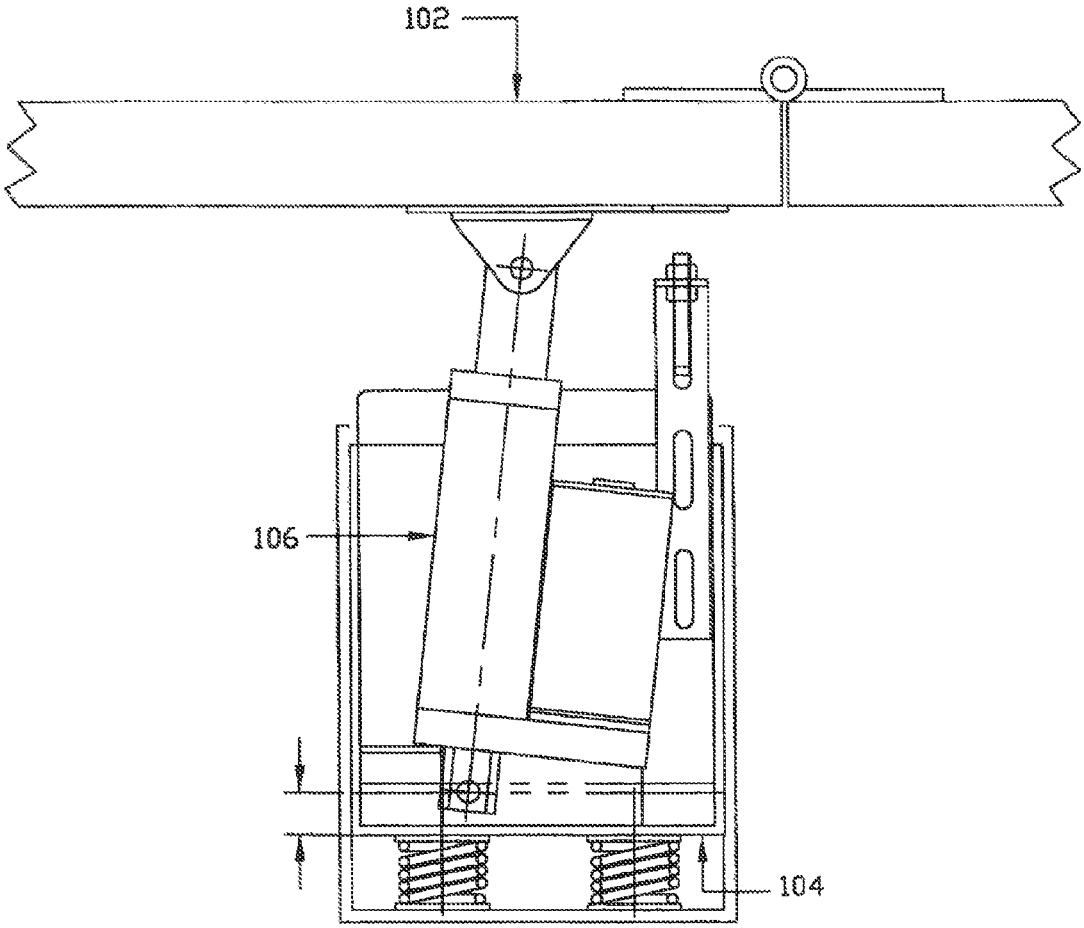
FIG. 12 includes an A-A view of an embodiment as depicted in FIG. 10, with a preferred actuator when the door is in a closed position, the door and door opener are in contact and the latter still extended, and shown with shock absorbing structure, in accordance with the instant invention.

In one embodiment, the system 5 further comprises providing a cushion mechanism 142 to minimize mechanical shock, in the event the door 102 is mechanically shocked, jarred, crashed into, or otherwise hit intentionally or by accident, for example (FIGS. 11 and 12). In an electrical embodiment, as shown in the figures, damage can occur to the actuator 106 if there is an excessive mechanical shock to the door 102 and actuator 106, in the event that a cushioning mechanism 142 is absent. Similarly, when the actuator 106 is a pneumatic mechanism, the cushioning mechanism is provided by the air pressure in the system, otherwise internal to the mechanism.

Also in one embodiment, the system 5 further comprises positively tracking and time stamping the opening and dosing of the door, travel through the opening, logging the duration when open, and management for lighting the desired area. Further, the system 5 can comprise sensing or counting the number of times a person goes through the door opening, which can be desirable for tracking of field and delivery activity. And, the system can comprise providing battery back-up and a charging system for the battery back-up to power the system 5, a security system and independent battery powered lighting, if desired, in certain applications.

In addition, the system 5 can further comprise providing an interface with a security system for providing a fully integrated lock and alarm system.

Referring to FIGS. 2 and 3, in its simplest form, an emergency exit door delivery management system (DDMS) 100 adapted for use with a conventional emergency exit door 102, is shown. The conventional emergency exit door includes a so called "panic bar" 101, and a door closure mechanism 103, both are preferred or required in one embodiment, for the DDMS 100 to operate properly. The DDMS includes: a door opener mechanism 104 for pushing the emergency exit door 102 open; an electric door strike 110 mountable to a door frame 112 to release the panic bar latch; a controller (or control box) 120 electrically connected to the door opener 104 and the door strike 110; an activation device, such as a keypad 128 or an RF key fob 126; and optionally a motion sensor 132. Advantageously, this system and structure enables the system as detailed in FIGS. 1 and 2. Advantageously, the system 5 and DDMS 100 are cost effective and retrofitable systems which can be adapted for use in already installed sites and applications.

Figure 18:
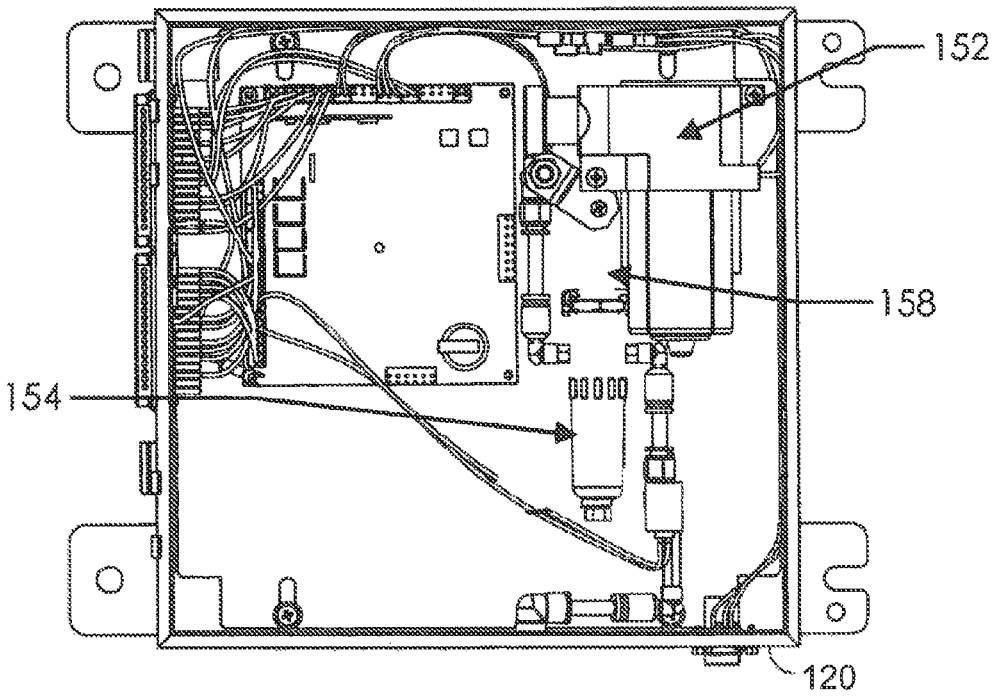
FIG. 18 shows the interior of a control box used with an embodiment of the entry system.
Figure 19:
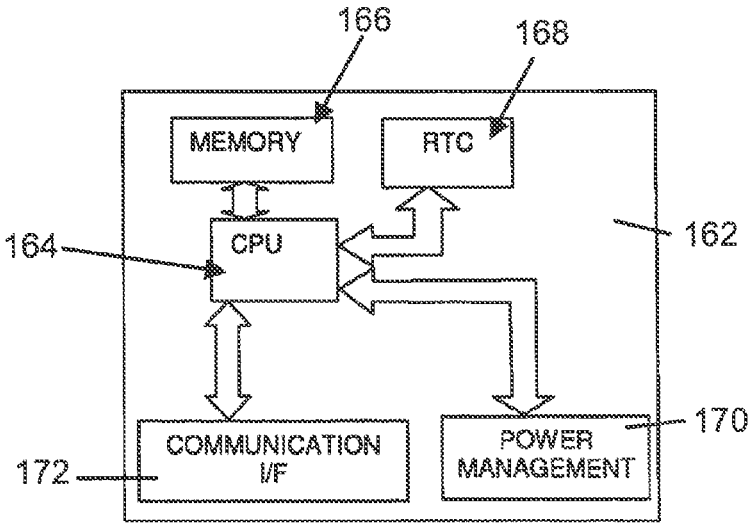
FIG. 19 is a schematic of the electronics used in a control system of the entry system.

In a preferred embodiment, as shown in FIGS. 18 and 19, the control box 120 includes: a backup battery, a wiring harness with appropriate connectors, and a controller board 162 with a microcontroller 164, memory 166, real-time clock 168, power supply 170, backup battery charging circuit, A/D converter to measure system voltages, temperature sensor, input and output interfaces, a communication interface 172 (such as an RS-232), an RF key fob signal receiver with an internal or external antenna, door opener mechanism power driver circuit, and a keypad interface.

All drawings described below, are shown in connection with an emergency exit door with hinges on the right side. As will be appreciated by those skilled in art, the DDMS 100 could also be used with the door 102 having hinges on the left side and with various pivot enabling door structure, for example, and with other changes and modifications, while staying within the scope of the instant teachings.

Figure 4:
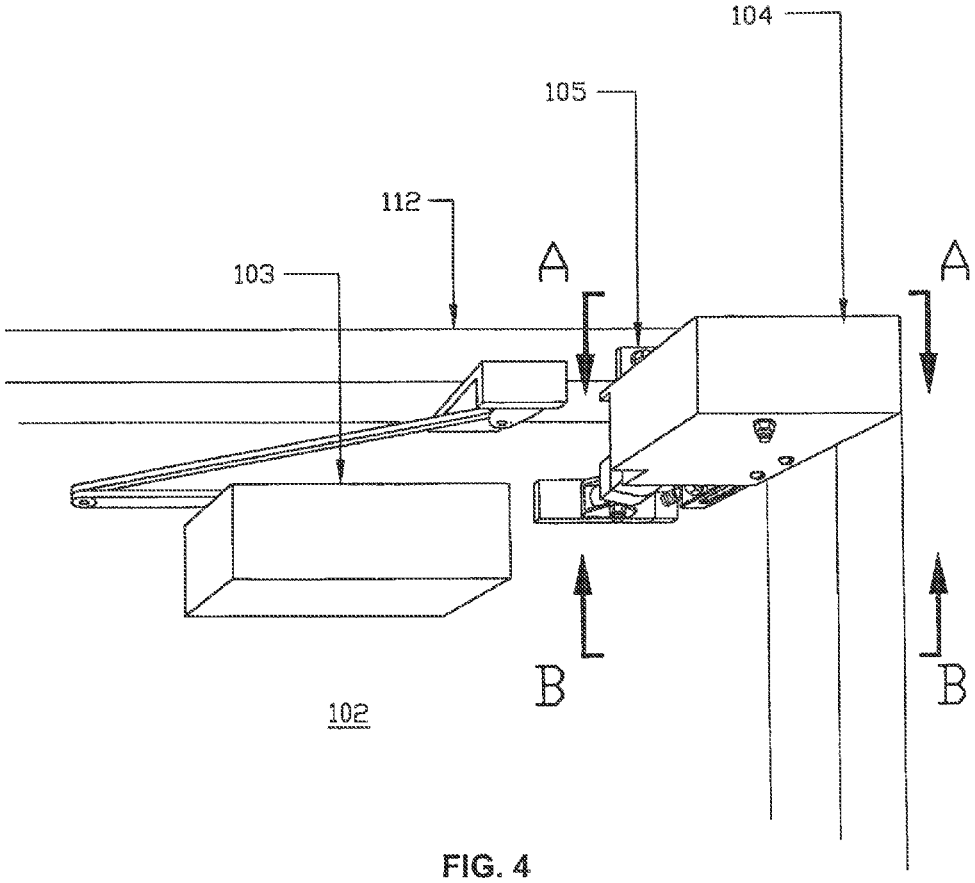
FIG. 4 includes an exploded view of an embodiment with a preferred placement of the door opener mechanism, in accordance with the instant invention.

FIG. 4 shows a view of the top corner near the hinges of the emergency exit door 102. This figure also indicates the locations of two closer views: A-A and B-B used in FIGS. 6-17. The door opener mechanism 104 is firmly mounted to the emergency exit door frame 112 using a steel or thick aluminum bracket 105. The bracket 105 needs to be able to support the door opener mechanism 104 during the door opening operation, and sustain any potential abuse. The door closure 103 provides continuous force to keep the emergency exit door 102 closed and is essential for the DDMS 100 to work, since the door opener mechanism 104 is not attached in any way to the door 102, and it provides an opening force only (in a preferred embodiment). This opening force needs to overcome the closing force from the door closure 103, and also magnetic force provided by magnets 109 near the electric strike, as shown in FIG. 5.

FIG. 5 represents a part of the emergency exit door 102 near the panic bar 101 with a latch 116, and a door frame mounted electric strike 110 with a gate 118 controlled by an internal solenoid. There are two magnets 109 mounted on the door near the strike 110 to provide an additional force to keep the door tightly closed and make sure that the panic bar latch 116 is not touching the strike electric gate 118 when it needs to be energized to release the latch 116 during the opening process. As an alternative, the magnets 109 could be mounted on the door frame 112 near the strike 110. If either: the emergency exit door 102, or the door frame 112 are not made of steel, a small steel plate mounted on the opposite side is preferably provided for the magnets 109 to work properly with the door, as detailed herein.

FIGS. 6 to 16 show the A-A views of the door opening mechanism using an electric actuator 106, which is not attached in any way to the emergency exit door. A typical opening mechanism 104 assembly contains: a linear actuator 106 (preferably either electric or pneumatic) with an interface adapter 136 to push the door open when the actuator 106 is energized, a door position sensor 130, a bracket to attach the assembly to the door frame, an assembly cover, and in the case of a pneumatic system, it may also contain an air compressor 152, a pressure regulator 158, air valves, filters, and air hoses. As an alternative, the pneumatic devices supporting the air cylinder actuator could be mounted in a separate box, or even in the control box 120 together with the system electronics. In one embodiment, shown in FIG. 6, the linear actuator interface adapter may contain a force alignment shoe 134 attached to the movable distal arm 108, and the door may be configured with a slider pad 136, made out of Teflon, or a similar material. Another embodiment is provided in FIG. 13, where a force centering roller 144 and a specially shaped, complementarily configured, force centering adapter 146, attached to the door, are used to interface the linear actuator 106.

FIG. 6 shows the door 102 in the closed position and the linear actuator 106 with the distal arm 108 retracted. When a delivery or service is initiated, a delivery or field worker sends or initiates a request to open the emergency exit door 102, by either pressing the RF key fob 126 button or punching a code on the keypad 128. The RF key fob signal is received through the antenna 124 and the RF receiver inside the box (FIG. 2). At this time, the controller may disable the alarm, turn the lights on, enable motion sensor 132, if those options are selected. It will energize the electric strike 110 to release the panic bar latch 116, and a fraction of a second later it will activate the linear actuator 106. If the pneumatic system is used, the controller may need to turn the air compressor on and open the air valve to let the air enter the air cylinder. The linear actuator 106 extends the movable distal arm 108, which forces the door 102 to open, as is shown in FIG. 7. The length of the movable distal arm 106 determines the opening angle of the door 102. The angle could be as small as 15 deg, or as large as 90 deg. Since the door is not attached to the movable distal arm 106, it could be pulled out and kept open, as desired by the user (FIG. 8). In a preferred embodiment, after a predetermined time, the movable distal arm 106 retracts back. In the case of the pneumatic system, after a predetermined time, the air pressure is released from the air cylinder, and the pressure release valve is kept open until the door 102 is fully closed.

Figure 9:
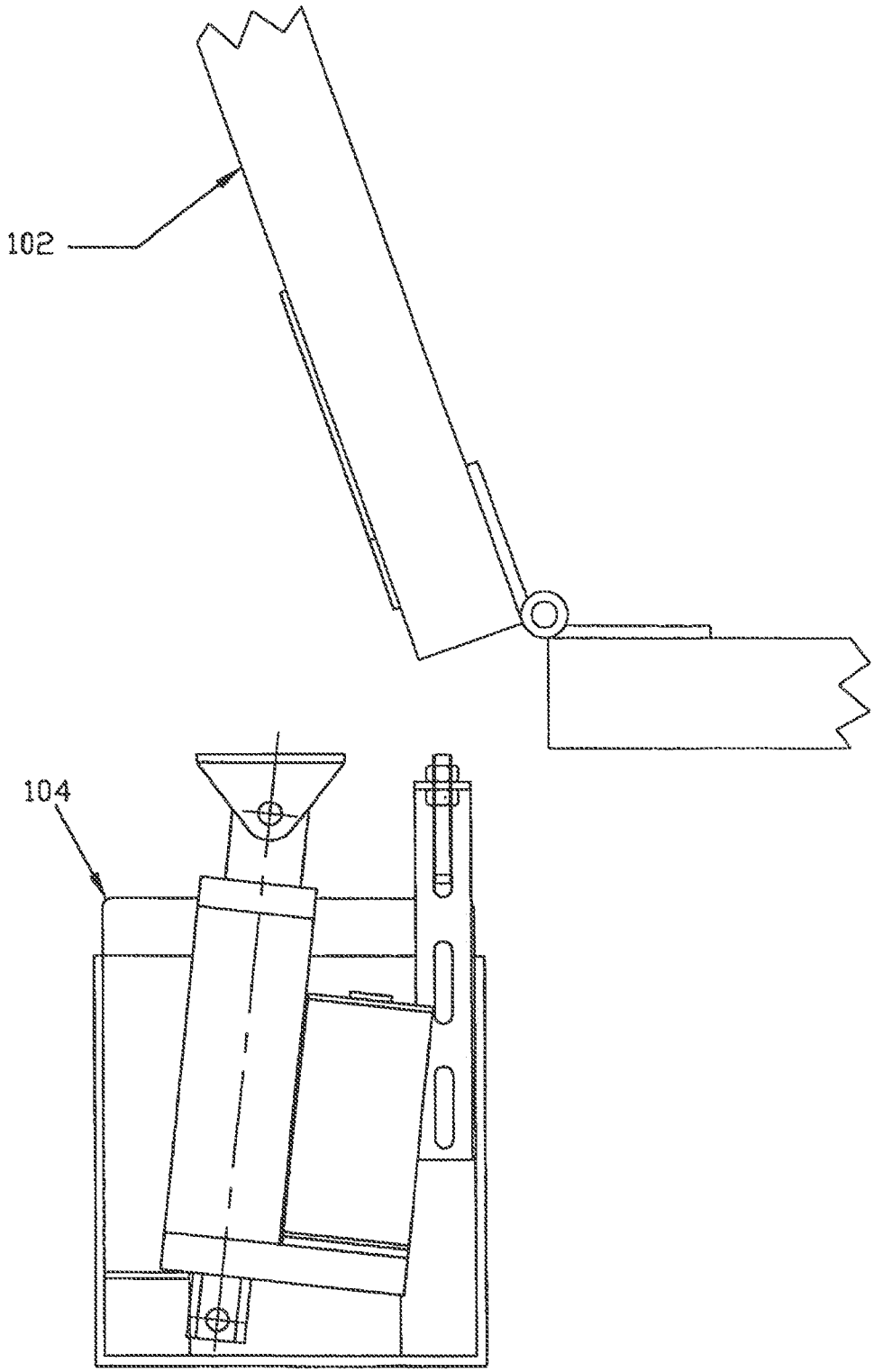
FIG. 9 includes an A-A view of an embodiment as depicted in FIG. 4, with a preferred actuator when the door is opened by a person using an emergency exit, and the door and door opener are substantially shown not in permanent contact, in accordance with the instant invention.

FIG. 9 shows that the emergency exit door 102 can always be opened manually, no matter what the position of the door opener mechanism is.

Figure 10:
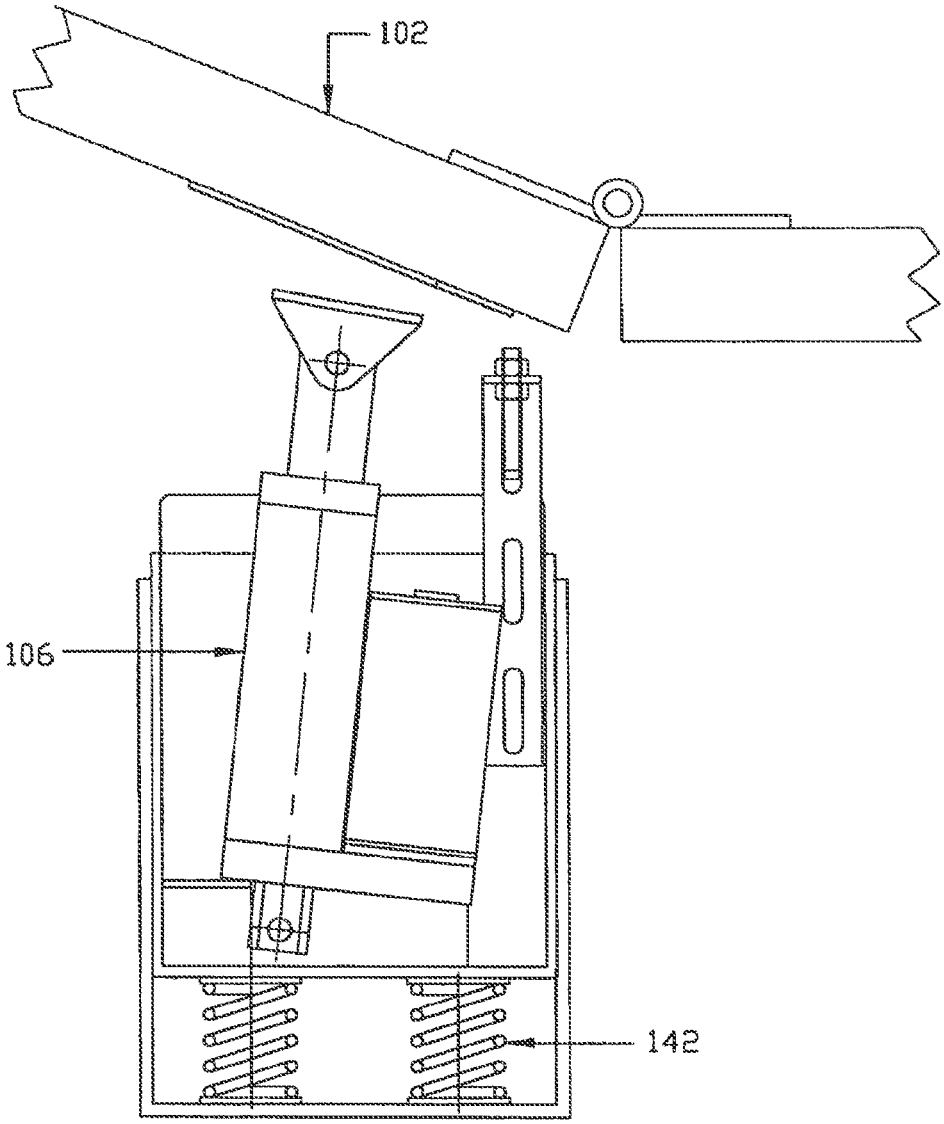
FIG. 10 includes an A-A view of an embodiment as depicted in FIG. 4, with a preferred actuator when the door is in a partially opened position, the door and door opener are substantially shown not in permanent contact, and shown with shock absorbing structure, in accordance with the instant invention.

FIG. 10 shows optional spring shock absorbers 142 to the door opener mechanism 104. This option will protect the linear actuator 106 from damage in case there is an obstruction behind the door, or if the operator hits the door 102 with a delivery cart, while the movable distal arm 108 is still in the extended position. FIGS. 11 and 12 shows the possible scenario, when the door 102 is being open and then forcefully closed with the distal arm 108 still extended, and the shock absorbers 142 protecting the linear actuator 106 from damage.

If the door 102 needs to be open to 45 deg or more, a preferred embodiment includes use of the force centering roller 144 and the force centering adapter 146, as described previously (FIG. 13).

FIGS. 13, 14, 15, and 16 show a typical DDMS operation with movable distal arm 106 in various positions. In a preferred embodiment, the distal arm 106 moves to the fully retracted position after a predetermined time (FIG. 15), and the door 102 can still be kept open.

Figure 17:
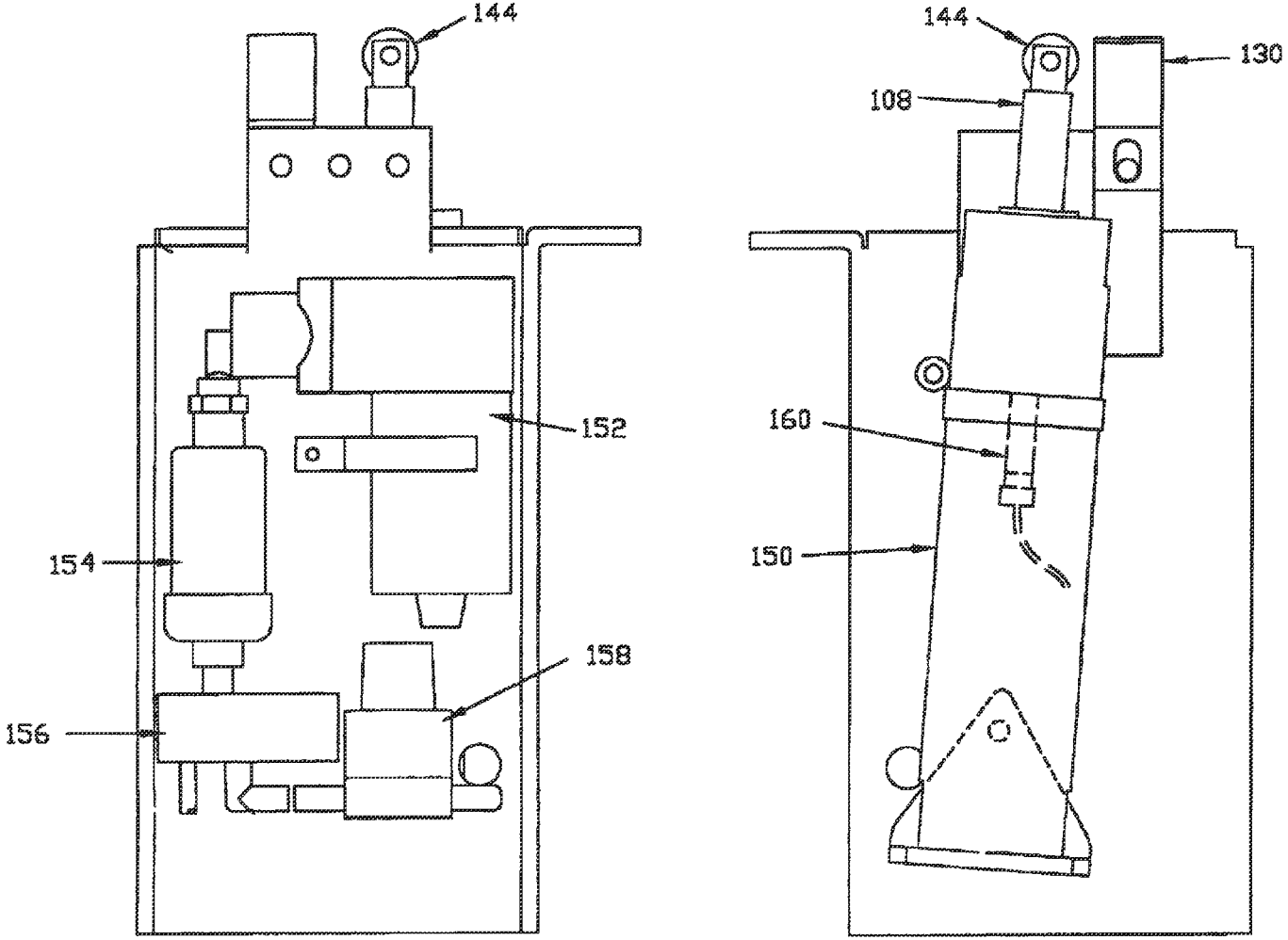
FIG. 17 includes an A-A and B-B views of a preferred embodiment as depicted in FIG. 4, when the actuator is a pneumatic device, in accordance with the instant invention.

The pneumatic version of the door opening mechanism 104 is presented in FIG. 17. It contains: an air compressor 152 to provide compressed air during the door opening process, a filter/water separator 154 to remove any moisture from the compressed air, a 2-way valve 156, with its normally open port used for the compressed air to pass to a pressure regulator 158 which limits the air pressure to maximum set by the regulator dial, and an air cylinder 150 used as a linear actuator (View B-B). A door position sensor 130 is used to determine if the door 102 is closed, and an air cylinder position sensor 160 is used to determine when the door is open, as required by the system—a locator band with the sensor 160 is adjustable to set the maximum opening angle. The electronic controller 120 turns the compressor 152 on for the time needed to open the door, or until the internal preset time expires. The system could be setup to have the door 102 partially, or fully open during this process. The door 102 will close automatically after certain amount of time, determined by another internal timer. This time could be as long as, for example, 30, 60 or 90 seconds, or any other time determined by the user. The door 102 may also become closed by the operator sending a close door request. In one embodiment, the close door request signal may be sent by pressing an RF key fob button. When the close door request is provided, the electronic controller activates the 2-way pressure relief valve 156 with the normally closed port open to atmosphere. This activation releases the air pressure from the air cylinder 150. Closing of the door 102 in the DDMS 100 always requires the closure 103 to move the door 102 to the closed position. If there is a restriction preventing the door 102 to reach its closed position, the controller 120 will maintain the 2-way pressure relief valve 156 energized to continue bleeding the air from the air cylinder 150, until the door 102 is closed. Door closing requests initiated by the user, deactivates the DDMS 100, and the open pressure relief valve 156, until the door 102 is closed.

If the actuator 106 fails to open the door 102 within a given time, it is possible to send another opening request and the DDMS 100 will try to correct the problem. It is desirable for the user, however, to verify the reason of the opening failure. Once the actuator position sensor detects the distal arm fully extended, the further opening requests are not allowed.

The controller 120 includes memory to record the time and duration of when the door has been opened. This is beneficial, as this provides the time of the delivery and duration, to track field personnel efficiency, time stamping if an incident occurs, etc. Likewise, the DDMS 100 can further comprise a motion sensor 132, as shown in FIG. 2, for tracking field and delivery activity through a door opening of the emergency exit door 102.

In another embodiment, the controller 120 controls a charging of a system backup battery, if the main power source voltage meets an appropriate threshold. If there is a power outage, for example, the DDMS 100 would still operate, and deliveries would then not be interrupted or delayed in such instances.

The DDMS 100 can be integrated with an alarm system coupled to the controller 120, for enhanced security.

Those skilled in the art will recognize that a wide variety of modifications, alterations and combinations can be made with respect to the above described embodiments and system, without departing from the spirit and scope of the invention, and those modifications are to be viewed as being within the ambit of this invention.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. An entry system for use with a security door, comprising:

a security door including a panic bar configured to manually retract a latch so as to allow the security door to open;

a door opener including an actuator with an extendable arm movably extending from a first end of the actuator for pushing the security door open, said actuator having a second end opposite the first end, wherein the second end is mounted independent of the security door;

said extendable arm being movable along a longitudinal axis of the actuator and having a convex surface distal from the actuator;

a concave push surface mounted on the security door opposite the extendable arm;

a door strike mountable to a door frame having an opening to receive the latch of the security door, the door strike including a gate having a locked condition and a release condition;

a magnetic mechanism located in proximity to the door strike and the latch when the security door is in a closed position with respect to the door frame, the magnetic mechanism configured to apply a force to maintain the closed position and to connect the security door and door strike in a locked condition;

a controller electrically connected to the door opener and the door strike, the controller includes a transceiver for receiving a wireless signal from a remote activator to wirelessly open the security door;

the remote activator configured to provide an open signal, an alarm disable signal and a re-activate alarm signal, the open signal including a signal to the controller to place the gate in the release condition and then activate the door opener such that the convex surface of the extendable arm travels along the concave push surface to open the security door.

2. The system of claim 1, wherein the controller includes: a microcontroller and a communication interface comprising the transceiver for receiving the open signal from the remote activator to open the security door.

3. The system of claim 1, wherein the controller is electrically connected to the door opener and door strike, defining a communication interface, and the controller includes a door position sensor to determine if the door is in an open position or the closed position, and an actuator position sensor to determine if the extendable arm of the actuator is extended or retracted.

4. The system of claim 1, wherein the magnetic mechanism includes a first magnet located on the security door and a second magnet on a door jamb, connecting and aligning the security door when the security door is in the closed position and disconnected when the security door is in an open position.

5. The system of claim 1, wherein the controller includes: a microcontroller, a real-time clock, a power management circuit, and a communication interface comprising the transceiver, a temperature sensor, and memory.

6. The system of claim 5, wherein the real-time clock sends a signal directing the controller to close the door after a set period of time.

7. The system of claim 6, wherein the set period of time is less than one minute.

8. The system of claim 1, wherein the magnetic mechanism includes a first and a second magnet that are located on the security door connecting the security door and door strike in the locked condition.

9. The system of claim 1, further comprising an alarm system coupled to the controller.

10. The system of claim 1, further comprising a motion sensor for tracking activity through an opening created by the opening of the security door.

11. The system of claim 1, wherein the magnetic mechanism is configured to help align the latch in the opening.

12. The system of claim 1, wherein the concave push surface is connected to an interior of the security door.

13. The system of claim 1, wherein the extendable arm includes a convex surface and the security door includes the concave push surface connected to an interior of the security door, the convex surface and the concave push surface being complementarily configured.

14. The system of claim 1, wherein:

a first alignment cushion is positioned along a side of the actuator parallel to a longitudinal axis of the actuator and adjacent to a first sidewall of a housing; and a second alignment cushion is positioned along a side of the actuator perpendicular to the longitudinal axis of the actuator and adjacent to a second sidewall of the housing perpendicular to the first sidewall.

15. An entry system for use with a security door, said system comprising:

a security door including a panic bar configured to manually retract a latch so as to allow the security door to open when the panic bar is depressed;

a door opener including a stationary actuator with an extendable arm movably extending from a first end of the actuator, said actuator having a second end opposite the first end and mounted independent of the security door, said extendable arm being movable along a longitudinal axis of the actuator and having a convex surface distal from the actuator for pushing the security door open;

a concave push surface mounted on the security door opposite the extendable arm;

an electric door strike mountable to a door frame having an opening to receive the latch of the security door, the door strike including a gate having a locked condition and a release condition;

a magnetic mechanism located in proximity to the door strike and the latch when the security door is in a closed position with respect to the door frame, configured to apply a force to maintain the closed position and is configured to align the latch in the opening when the security door is in the closed position;

a controller electrically connected to the door opener and the door strike, the controller includes a transceiver for receiving a signal from a remote activator to wirelessly open the security door, such that the convex surface of the extendable arm travels along the concave push surface to open the security door;

the remote activator configured to provide an open signal, an alarm disable signal and a re-activate alarm signal.

16. The system of claim 15, wherein the magnetic mechanism includes a first and a second magnet that are located on the security door connecting and aligning the security door and jamb in the closed position of the security door and disconnecting when the security door is opened after the gate has been placed in the release condition, the magnetic mechanism applies a force to help maintain the closed position of the security door.

17. The system of claim 15, wherein the controller is integrated with an alarm system.

18. The system of claim 15, wherein:

the security door includes the concave push surface connected to an interior of the security door; and the convex surface and the concave push surface are substantially complementarily configured so as to define a contact surface.

19. The system of claim 15, wherein the magnetic mechanism includes a first magnet and a second magnet, to maintain the security door in the closed position.

20. An entry system for use with a security door, comprising:

a door opener including an actuator having an extendable arm movably extending from a first end of the actuator for pushing the security door to an open position, said extendable arm being movable along a longitudinal axis of the actuator between a retracted position and an extended position;

said actuator having a second end opposite the first end and mounted independent of the security door; and a convex surface disposed on the extendable arm in removable contact with a concave push surface mounted on the security door, wherein the actuator develops a linear force and such linear force is directly exerted against the concave surface by the extendable arm.

21. The entry system of claim 20, wherein the convex surface is at an end of the extendable arm distal to the actuator.

22. The entry system of claim 20, wherein:

the actuator receives a signal from a wireless device; and the extendable arm pushes the security door open in response to the signal.

23. The entry system of claim 20, wherein the linear force necessary to open the security door is supplied by the extendable arm pushing against the security door.

24. The entry system of claim 20, wherein an end of the extendable arm is opposite the concave push surface.

25. The entry system of claim 24, wherein the convex surface is disposed on the end of the extendable arm opposite the concave push surface.

* * * * *